United States Patent [19]

Ratelband

[11] 4,412,524

[45] Nov. 1, 1983

[54] FIRE-GUARD

[76] Inventor: John B. Ratelband, Utrechtsestraat 55-34, Rynstateflat, 6811 LV Arnhem, Netherlands

[21] Appl. No.: 303,844

[22] Filed: Sep. 21, 1981

Related U.S. Application Data

[63] Continuation-in-part of Ser. No. 105,566, Dec. 20, 1979, Pat. No. 4,304,216, which is a continuation-in-part of Ser. No. 86,768, Oct. 22, 1979, abandoned.

[30] Foreign Application Priority Data

May 14, 1979 [NL] Netherlands ..... 7903778

[51] Int. Cl.[3] ..... F24B 7/00

[52] U.S. Cl. ..... 126/121; 126/140; 126/202; 160/DIG. 9; 160/121; 160/135; 160/210; 165/77; 165/172; 165/DIG. 2; 237/51

[58] Field of Search ..... 126/121, 138, 109, 202, 126/140; 237/51; 16/DIG. 29; 285/273, 188; 138/111, 116; 432/65, 247; 165/77, 172, 137, DIG. 2, DIG. 12; 160/129, 135, 210, 232, DIG. 9

[56] References Cited

FOREIGN PATENT DOCUMENTS

| | | | |
|---|---|---|---|
| 1344299 | 10/1963 | France | 126/121 |
| 213359 | 4/1974 | United Kingdom | 126/121 |
| 901860 | 7/1962 | United Kingdom | 126/121 |

*Primary Examiner*—Samuel Scott
*Assistant Examiner*—Randall L. Green

[57] ABSTRACT

A fire-guard device is provided for heating a room by convection using the heat from a conventional radiation heat source. The device includes a plurality of pipes in which all adjacent pairs of pipes are pivotably interconnected together. Each pipe is mounted in its own piece of tubing. Each piece of tubing has hinge eyes joined thereto for use in providing the pivotal connection between pipes. The pieces of tubing and hinge eyes form a threshhold for the relatively cool air flowing to the device over the floor of the room in which the device is located.

5 Claims, 6 Drawing Figures

FIRE-GUARD

CROSS-RELATED PATENT APPLICATIONS

This application is a continuation-in-part application of U.S. patent application Ser. No. 105,566 filed Dec. 20, 1979, now U.S. Pat. No. 4,304,216, which is a continuation-in-part application of U.S. patent application Ser. No. 86,768, filed Oct. 22, 1979, which application is now abandoned.

BACKGROUND ART

The invention relates to a fire-guard essentially consisting of a row of spaced apart vertical pipes which are so secured to one another as to form a grid-shaped screen and have each in a place adjoining or at a relative short distance above the base of the fire-guard an inlet opening, said fire-guard having adjacent pipes which are hinged together for pivoting about a vertical axis.

A fire-guard of this construction has been disclosed by the French specification No. 1 344 299. This known fire-guard consists of three groups of rigidly interconnected pipes, said groups being hinged to one another. It can only be erected in the shape of a trapeze and in a collapsed condition it is still a body which occupies relatively much space. Furthermore, damaged pipes cannot be replaced easily.

The invention has the object to provide an improvement of the known fire-guard, whereby the latter can be erected in front of the fire in many different shapes, broadened or narrowed at will and transported and put away in a number of parts of small dimensions.

SUMMARY OF THE INVENTION

According to the invention this improvement of the known fire-guard is seen in that in all pairs of adjacent pipes of the fire-guard the two pipes are detachably hinged together for pivoting about a vertical axis. Due to the fact that all pipes of the fire-guard are hinged to one another the fire-guard can be erected in any desired bend in front of the fire place or other source of radiation and rolled up, whereby the transport and the putting away of the fire-guard are facilitated. Furthermore, as all pipes are easily detached from one another, the fire-guard can be dispatched and put away as a bundle of individual pipes. Moreover, the fire-guard can be composed of any desired number of pipes, so that the width of the fire-guard can be adapted to the requirements.

A simple construction of the fire-guard is obtained, when the hinge joint between two adjacent pipes locally consists of an eye attached to one of said pipes and having a vertical hole and of a pin attached to the other one of said pipes and extending through said eye, said pin being adapted to be vertically removed out of the eye.

It has appeared that the effect of the fire-guard can be increased, when the lower part of the fire-guard extending over a given height is so closed, as to form a threshhold for the air flowing between the pipes. First, this threshhold minimizes the unfavorable influence of the suction caused by the chimney draft on the air in the vicinity of the inlet opening of the pipes of the fire-guard so that these pipes will transport more air, and secondly a part of the combustion air sucked by the chimney into the fire is preheated. Such a threshhold is automatically obtained, when between the two pipes of each pair of adjacent pipes a hinge having a vertical pivoting pin and separable hinge leaves, each of which is attached to its own pipe, is provided and said hinge extends in the lower part of the fire-guard over a predetermined height and blanks, over said height, the space left between the two pipes.

A fire-guard with a threshhold can be manufactured in a simple way, if each pipe is mounted on its own piece of tubing and the pieces of tubing of each pair of adjacent pipes are detachably hinged to one another by a hinge which blanks the space between the pieces of tubing of the pair concerned and consists of overlapping eyes having coaxial vertical holes and being bent from lips which are formed on the wall of each one of the two adjacent pieces of tubing and of a removable vertical pivoting pin extending through the holes of said eyes. Each piece of tubing may advantageously consist of two shells and may, furthermore, be so constructed that the hinge-eyes of said piece of tubing are bent from lips formed on the longitudinal edges of the two shells and the shells are interconnected only by the pivoting pins extending through the holes of their eyes. The shells can each be formed easily from a flat sheet. Another simple construction of the piece of tubing and the hinge parts formed thereon is obtained, when for each piece of tubing a tube is used and the hinge-eyes of said piece of tubing are bent from lips which are punched out of the wall of said tube but are permanently connected with one edge with said wall. By bending eyes from said lips inlet openings are automatically formed.

In many cases it is recommended to make the diameter of each piece of tubing larger than that of the pipes, thereby the fire-guard becomes more rigid and the inflow of air will become more favorable. Moreover, in that case the leaves or eyes of the hinges then require less long lips on the wall of the pieces of tubing. The inflow will be further improved, if each piece of tubing is provided in its wall with at least one inlet opening.

When pieces of tubing of large diameter are used it is possible that the distance between the pipes becomes too great to ensure sufficient protection against flying sparks. In that case each pivoting pin provided between two pieces of tubing may be connected by a vertical chain to the hinge joint provided near the upper ends of the pipes mounted on said pieces of tubing. This chain divided the too wide space between the pipes up into two considerably narrower, consequently safer, slits.

Additional advantages of the present invention will be readily seen from the following description when taken in conjunction with the accompanying drawings.

DETAILED DESCRIPTION OF THE INVENTION

Figure 1:
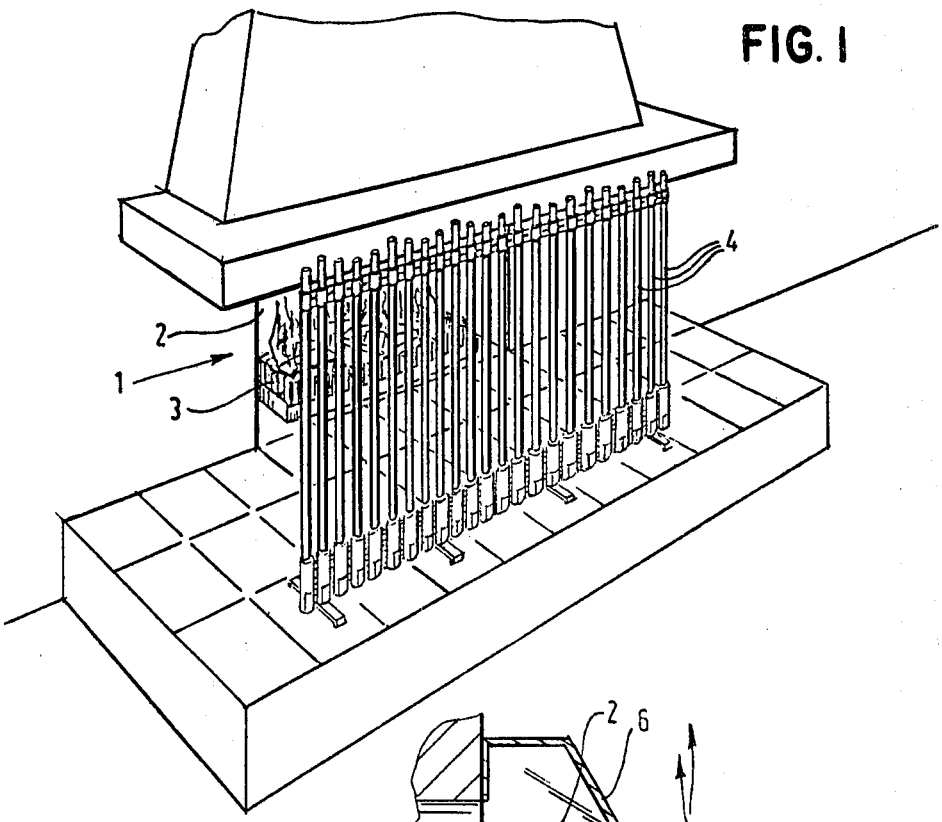
FIG. 1 is a perspective view of an open fire with a fire-guard according to the present invention placed in front of the fire.

Shown in FIG. 1 is an open fire 1 having a fire space 2 with a grate 3. Placed in front of the fire space is a fire-guard which consists of a row of vertical metal pipes 4 spaced apart at short distances. These pipes are so long as to protrude with their upper ends beyond the upper edge of the fire space opening. It is apparent from FIG. 1 that the pipes 4 need not be equally long.

If the pipes 4 are hit by the radiation emitted by the fire, they and the air contained in them are heated, so that they will start to operate as chimneys and will suck cooler air from the layer of air near the floor of the room to be heated, heat this air and return at their upper ends the heated air into the room. Consequently, the fire-guard does not only arrest flying sparks from the fire, screen-off the often very strong radiation and prevent one to touch the hot grate and the fire, but it has at the same time the task to so convert the otherwise insufficiently effective radiation energy into heat to be given off to the air in front of the fire place, to ensure that the air circulation which is so important for the even heating of the air contained in the room automatically occurs.

Figure 2:
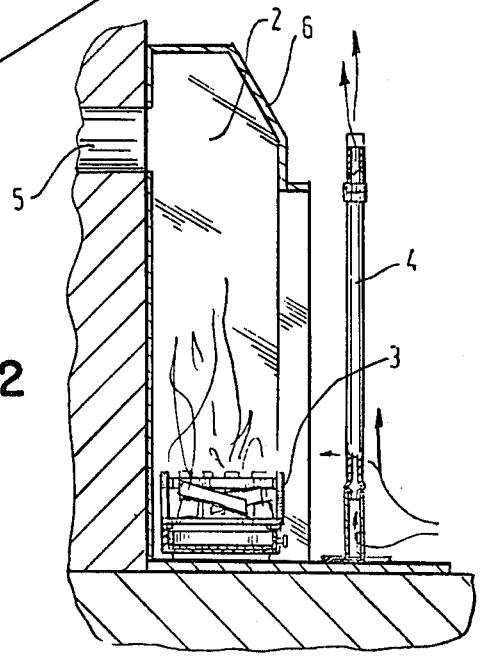
FIG. 2 is a vertical sectional view of a slightly different open fire and the fire-guard shown in FIG. 1.

In FIG. 2 the fire-guard shown in FIG. 1 is placed in front of a movable open stove 6 which is connected to a chimney opening 5.

The fire-guard can be constructed in many different ways as can be understood from a reading of the following description and the above noted cross-related patent applications.

Figure 3:
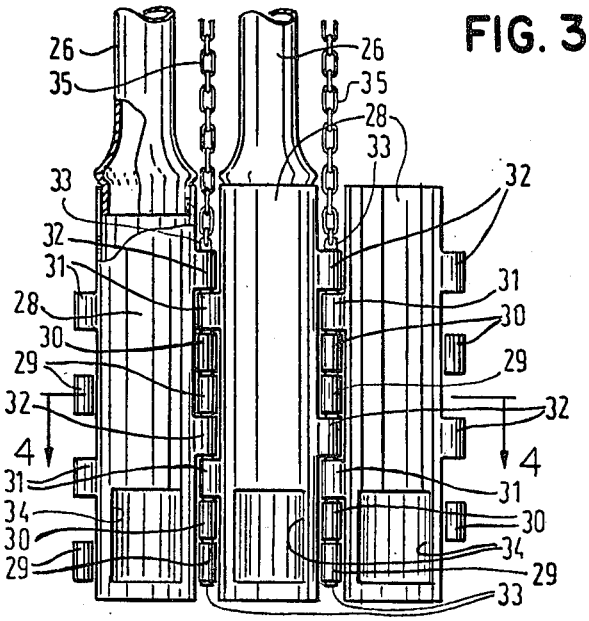
FIG. 3 is a partly broken away front view of a part of a fire-guard constructed in accordance with the invention.
Figure 4:
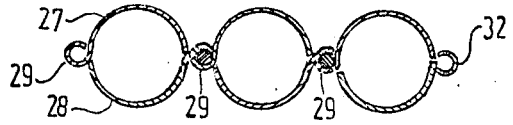
FIG. 4 is a horizontal sectional view taken on line 4—4 of FIG. 3.

With reference to FIGS. 3 and 4, it is seen that the fire-guard is composed of pipes 26, which are fittingly inserted with their widened lower ends into pieces of tubing which each consist of two semi-cylindrical sheels 27, 28 and have a diameter which is larger than that of the pipes 26. Formed on the two longitudinal edges of each one of the two shells are lips which are so bent as to form hinge-eyes. Each rearmost shell 27 has formed on its left hand edge the eyes 29 and on its right hand edge the eyes 30, whereas each foremost shell 28 has formed on its left hand edge the eyes 31 and on its right hand edge the eyes 32. The two shells 27, 28 are held together by a pin 33, which acts at the same time as pivoting pin of the hinge provided between two adjacent pieces of tubing. The foremost shells 28 have inlet openings 34. Since the distance between the pipes is rather great, in each space between adjacent pipes a chain 35 is stretched for the sake of safety between the pivoting pin 33 and the hinge joint (not shown) near the upper ends of the pipes. Furthermore, it is observed, that all hinge-eyes 29, 30, 31 and 32 of the four shells 27 and 28 which border the intermediate space, in which said hinge-eyes protrude, adjoin each other and thereby form together a threshhold for the air sucked into the fire.

Figure 5:
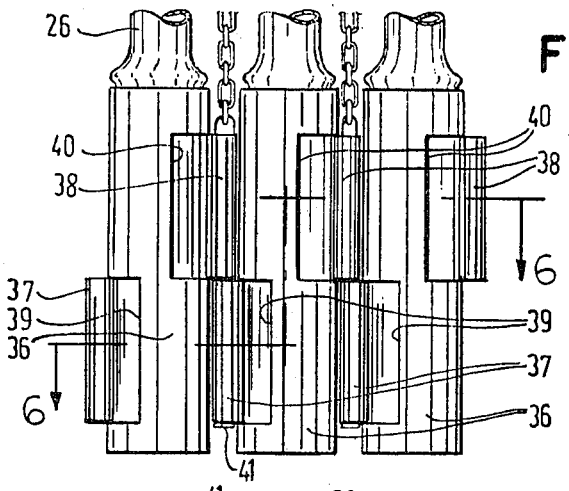
FIG. 5 is an elevational view of a part of another variant of the fire-guard.
Figure 6:
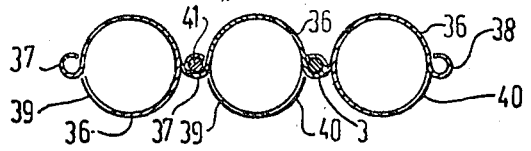
FIG. 6 is a horizontal sectional view taken on the line 6—6 of FIG. 5.

The fire-guard shown in FIGS. 5 and 6 has also pipes 26 mounted on pieces of tubing. These pieces of tubing consist each of a tube 36, of which the diameter is larger than that of the pipes 26. Punched out of the wall of each tube are two lips which remain connected with said wall with one edge and are bent to form tubular hinge members 37 and 38. In the places 39 and 40, where the lips for the tubular hinge member 37 and 38 are bent out of the wall of the tube, inlet openings are formed automatically. The tubular members 37, 38 which adjoin each other form together with the pivoting pin 41 the lower hinge joint between adjacent pipes 26 and form at the same time a threshhold.

It will be apparent that in this case the pipes 26 and the tubes 36 may be replaced either by pipes which widen towards their lower ends or by throughgoing straight tubes.

The embodiments described by way of example only illustrate fire-guards having round pipes. However, it will be obvious that the pipes may also have other cross sectional areas. The fire-guard may as well be used for other sources of radiation than open fires.

Although the present invention has been described with reference to only some embodiments, it is readily understood that variations and modifications can be effected within the spirit and scope of this invention.

What is claimed is:

1. A fire-guard for the conversion of radiation heat into convection heat adapted to be placed in front of a source of radiant energy located in a room to be heated by the source, the fire-guard comprising:

a plurality of adjacent upwardly extending pipes, each of said pipes having an inlet opening and an outlet opening;

a plurality of pieces of tubing, each of said pipes being joined to one of said pieces of tubing, each of said pieces of tubing having at least one inlet opening in communication with said inlet opening of one of said pipes; and hinge means interconnecting pairs of said adjacent pipes to secure said adjacent pipes together so that each of said pipes is pivotable about a vertical axis, said hinge means including overlapping eyes having coaxial vertical holes, said overlapping eyes being formed using adjacent pieces of tubing, said hinge means further including at least one removable vertical pivoting pin extending through eye holes of two adjacent pieces of tubing.

2. A fire-guard, as claimed in claim 1, wherein:

each of said pieces of tubing includes two shells, each of said two shells having at least one eye having a hole formed on a longitudinal edge thereof, said holes of said eyes being axially aligned, said two shells being interconnected by a pivoting pin extending through said holes of said eyes.

3. A fire-guard, as claimed in claim 1, wherein:

each of said pieces of tubing includes a tube and said eyes of each of said pieces of tubing are bent from lips which are punched out of the wall of said tube but are permanently connected with one edge to said wall.

4. A fire-guard as claimed in claim 1, further including:

a vertical chain connected to said vertical pivoting pin adjacent the upper ends of said two adjacent pipes.

5. A fire-guard for the conversion of radiation heat into convection heat adapted to be placed in front of a source of radiant energy located in a room to be heated by the source, the fire-guard comprising:

a plurality of adjacent upwardly extending pipes, each of said pipes having an inlet opening and an outlet opening;

a plurality of pieces of tubing, a portion of each of said pipes being surrounded by a portion of one of said pieces of tubing, each of said pieces of tubing having a bottom end and at least one inlet opening in communication with said inlet opening of one of said pipes, each of said pieces of tubing extending in a straight vertical direction, the entire bottom end of each of said pieces of tubing in contact with a surface supporting the fire-guard, said inlet openings of said pieces of tubing being located above said bottom ends of said pieces of tubing; and hinge means detachably joining pairs of said pieces of tubing to fill spaces between said pieces of tubing so that a threshold is formed for the relatively cool air flowing over the floor of the room towards the source of radiant energy.

* * * * *